US008573403B2

(12) United States Patent
Stevens et al.

(10) Patent No.: US 8,573,403 B2
(45) Date of Patent: Nov. 5, 2013

(54) BLISTER WITH TILTING SIDE-WALLS

(75) Inventors: Gerard Stevens, Huntleys Point (AU); Ian Stevens, Killara (AU)

(73) Assignee: Manrex Pty Ltd, Leichhardt, NSW (AU)

( * ) Notice: Subject to any disclaimer, the term of this patent is extended or adjusted under 35 U.S.C. 154(b) by 0 days.

(21) Appl. No.: 13/321,815

(22) PCT Filed: May 24, 2010

(86) PCT No.: PCT/AU2010/000623
§ 371 (c)(1),
(2), (4) Date: Jan. 27, 2012

(87) PCT Pub. No.: WO2010/135765
PCT Pub. Date: Dec. 2, 2010

(65) Prior Publication Data

US 2012/0118788 A1 May 17, 2012

(30) Foreign Application Priority Data

May 28, 2009 (AU) ..... 2009202203

(51) Int. Cl.
*B65D 83/04* (2006.01)

(52) U.S. Cl.
USPC ..... 206/532; 206/538; 206/528

(58) Field of Classification Search
USPC ..... 206/531, 532, 528, 538, 539
See application file for complete search history.

(56) References Cited

U.S. PATENT DOCUMENTS

| | | | | |
|---|---|---|---|---|
| 3,054,503 A | | 9/1962 | Hartman, Jr. | |
| 3,380,578 A | * | 4/1968 | Sparks | 206/484 |
| 4,574,954 A | * | 3/1986 | Reid | 206/531 |
| 4,753,352 A | | 6/1988 | Dauphin et al. | |

(Continued)

FOREIGN PATENT DOCUMENTS

| | | |
|---|---|---|
| AU | 97462/01 B2 | 7/2002 |
| DE | 3607012 A1 | 9/1987 |
| WO | 96/07601 A1 | 3/1996 |

OTHER PUBLICATIONS

Jagdish Wable, International Search Report for PCT/AU2010/000624, Jul. 20, 2010.

(Continued)

*Primary Examiner* — David Fidei
(74) *Attorney, Agent, or Firm* — Chernoff Vilhauer McClung & Stenzel LLP

(57) ABSTRACT

A blister sheet (1) has a generally rectangular blister (2) formed with one pair of longer side walls (7) having parallel steps (8) and a second pair of shorter side wall (9) devoid of steps. The side walls serve to space a front face (5) of the blister from the plane of a rupturable foil backing sheet (4) which retains medication doses (nor shown) inside the blister until they are to be taken. The medication doses are ejected from the cavity of the blister (2) by depressing its front face with finger pressure so that they are forced against the backing sheet (4) with sufficient force to rupture it. During the application of finger pressure to the front face (5) it bows downwardly in its central region as indicated by the broken outline. Simultaneously the end walls (9) tilt inwardly towards one another so that any medication doses lying against them are forced into the central region of the blister from which they can be ejected more easily by the descending front face (5).

1 Claim, 2 Drawing Sheets

(56) References Cited

U.S. PATENT DOCUMENTS

| | | | | |
|---|---|---|---|---|
| 4,854,450 | A | 8/1989 | Fisher | |
| 5,954,204 | A * | 9/1999 | Grabowski | 206/531 |
| 6,776,285 | B2 * | 8/2004 | Shibata | 206/469 |
| 6,951,353 | B2 * | 10/2005 | Kozlowski et al. | 283/81 |
| 2011/0114532 | A1 * | 5/2011 | Francois et al. | 206/528 |

OTHER PUBLICATIONS

Jagdish Wable, International Search Report for PCT/AU2010/000623, Jul. 21, 2010.

* cited by examiner

BLISTER WITH TILTING SIDE-WALLS

This is a national stage application filed under 35 USC 371 based on International Application No. PCT/AU2010/000623 filed May 24, 2010 and claims priority under 35 USC 119 of Australian Patent Application No. 2009202203 filed May 28, 2009.

FIELD OF THE INVENTION

THIS INVENTION relates to a blister of a blister sheet and is more specifically concerned with an improvement in, or a modification of the invention described and claimed in our Australian Patent No. 779458 (hereinafter referred to as "the parent patent").

STATE OF THE ART

The parent patent describes and claims an invention comprising a blister sheet formed with a blister having side walls and a front face which is held spaced from the plane of the back of the blister sheet by the side walls which are designed to yield gently while progressively collapsing from the front face in response to increasing finger pressure being applied to the front face. This enables older people to more easily depress the front face of a blister with sufficient force to eject medication doses from the cavity of the blister. This force must be sufficient to rupture a backing sheet sealing the cavity of the blister and also to buckle the side walls of the blister sufficiently to enable the front face of the blister to be pressed down as far as the backing sheet.

Medication doses within the blister may have many different sizes and shapes. Some of these shapes are such that it is possible for an occasional medication dose to be inadvertently trapped between a collapsing side wall of the blister and its front face while the latter is being pushed by finger pressure towards the backing sheet. An elderly patient may not notice that this has occurred and thus fail to take the total number of medication doses which a doctor has prescribed.

OBJECT OF THE INVENTION

An object of this invention is to provide an improved shape of blister.

THE INVENTION

In accordance with the present invention a blister sheet is formed with a blister having two pairs of side walls and a front face which is held spaced from the plane of the back of the sheet by the side walls, one pair of opposed sidewalls being so formed that they yield gently while progressively collapsing from the front face in response to increasing finger pressure being applied to the front face, and the other pair of sidewalls responding to the finger pressure by tilting towards one another so that any medication dose which might be located against a tilting side wall is displaced towards a position lying beneath the front face and from which it can be ejected by increasing pressure. This enables a blister to have its contained medication doses ejected through the backing sheet with more certainty than is the case with a blister having all of its side walls corrugated.

PREFERRED FEATURES OF THE INVENTION

Preferably the blister is of elongated shape and the first pair of sidewalls are rather longer than the second pair of side walls. The first pair of sidewalls are suitable formed with parallel steps, for example three such steps. The side walls of the second pair are suitably devoid of steps and are smooth so that their stiffness is not impaired and they can tilt gradually towards one another as finger pressure is applied to the front face.

INTRODUCTION TO THE DRAWINGS

The invention will now be described in more detail, by way of example, with reference to accompanying drawings, in which:

In the Drawings

Figure 1:
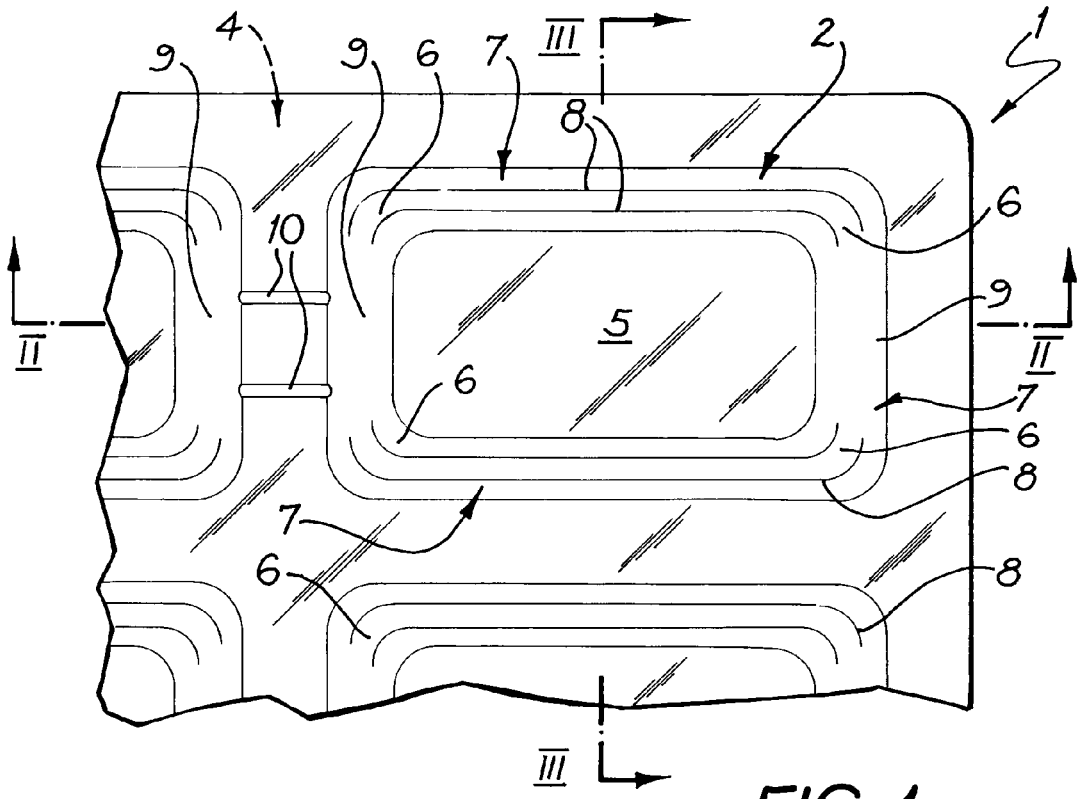
FIG. 1 is a plan view of a blister forming part of a blister sheet.
Figure 2:
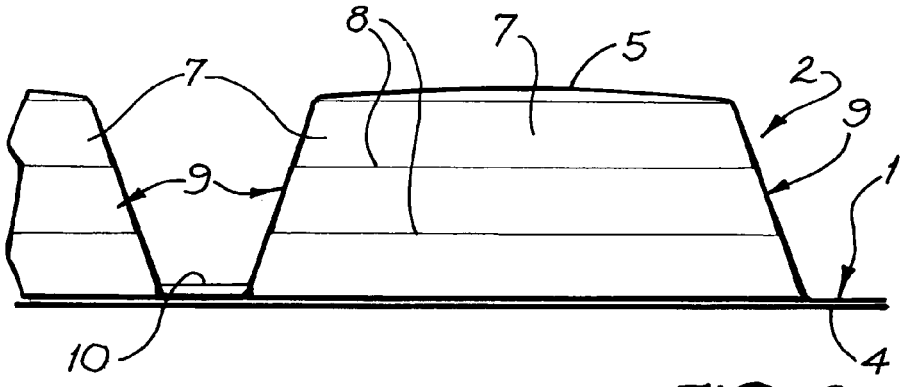
FIG. 2 is a diagrammatic vertical section through the blister of FIG. 1 taken on the line and in the direction indicated by the arrows 11-11 in FIG. 1.
Figure 3:
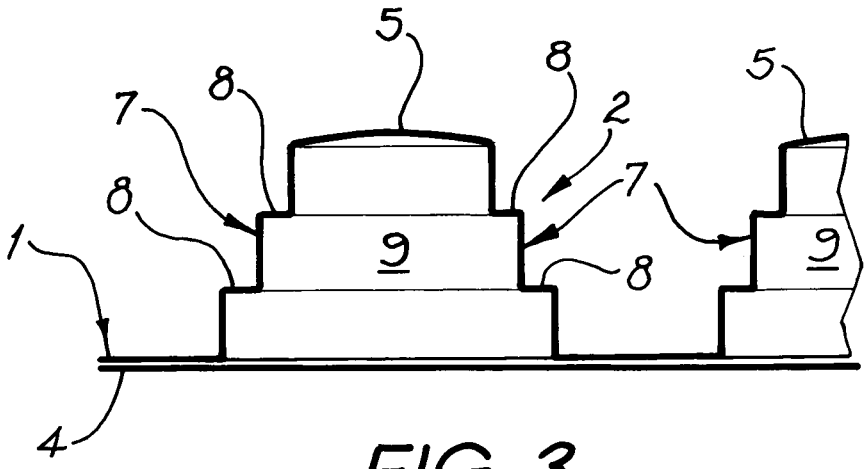
Figure 4:
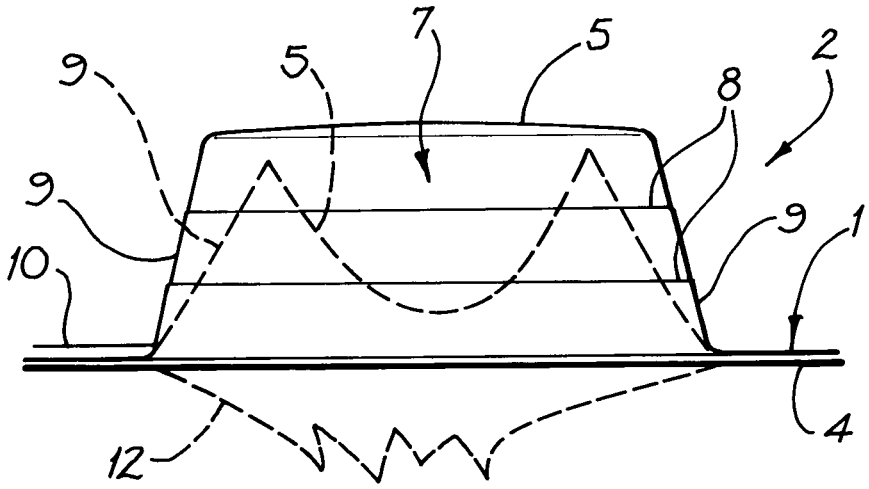

FIG. 3 is an end view of the blister of FIG. 1 taken on the line and in the direction indicated by the arrows 111-111; and, FIG. 4 is a view similar to FIG. 2 and shows a stage in the collapsing of a blister by finger pressure applied to its front face, the end walls of the blister and its front face being shown in full outline in its initial position, and in broken outline in an intermediate position it assumes during ejection of medication doses from the cavity of the blister.

DESCRIPTION OF PREFERRED EMBODIMENT

In order to avoid burdening the present specification with unnecessary detail concerning the way in which the blister sheet is used in conjunction with a foil backing sheet and a stiff folder, reference should be made to the specification of the parent patent for such detail and the reader is to understand that the blister sheet of the present invention is used in a similar manner.

Referring to FIGS. 1, 2 and 3 these show part of a transparent, vacuum-formed plastics blister sheet 1 having a blister 2 of generally truncated pyramidal shape and which protrudes from one side of the blister sheet 1. The blister tapers in the direction of its protrusion. A finger-rupturable, airtight backing sheet 4, which may be a thin metal foil, is adhesively sealed to the back of the sheet 1 around the marginal edge of the blister 2 and acts to seal prescribed medication doses (not shown) within the cavity of the blister.

The blister has a generally oblong and outwardly convex front face 5 with generously rounded corners 6 and is held spaced from the plane of the backing sheet 4 of the blister 2 by four side walls arranged in two pairs respectively referenced 7 and 9. The longer pair of side walls 7 are provided with parallel steps 8 which extend around the corners 6 and are parallel to the plane of the backing sheet 4. The shorter pair of parallel side walls 9 have flat central regions of generally trapezoidal shape as shown in FIG. 1 and which taper upwardly towards the front face 5 of the blister as clearly shown in FIG. 2.

Pairs of narrow, parallel, bleed openings are integrally formed in the blister sheet 1 provide narrow ducts 10 extending between the central portions of the neighboring shorter side walls 9 of respective blisters. These ducts have an internal cross-section of about one square millimeter and are about four millimeters long. They are integrally moulded with the blister sheet 1. The ends of the ducts 10 open into the cavities of respective blisters 1 so that air can escape from each blister, when its front face is depressed towards the backing sheet 4 by finger pressure, by way of the ducts 10 into the cavities of the neighboring blister or blisters 1. If either or both of the blisters to which the ducts 10 are connected, are connected to atmosphere as a result of their contents having already been ejected, the air passing through the ducts 10 discharges to atmosphere to relieve the pressure inside the blister being opened. On the other hand, if the neighboring blister at the other end of the ducts 10 is still intact, its shape allows it to dilate slightly to absorb the air passing through the ducts 10. Thus, in each case, the air-pressure inside the blister which is in the course of being opened, is not significantly increased and this makes opening of the blister easier as less finger pressure is required to depress its front face than would otherwise be required were the ducts 10 not present.

Operation of the Preferred Embodiment

In order to eject the medication doses contained in a particular blister cavity and which may be in the form of tablets or capsules, the patient depresses the front face 5 of the selected blister by applying finger pressure to it. The pressure is transmitted by way of the medication doses to the backing sheet 4 of the blister, causing it to rupture. The downward pressure on the front face 5 also causes air within the blister to flow through the ducts 10 at one or both ends of the blister cavity so that the depression of the front face causes negligible build-up of air pressure inside the blister being opened and which might otherwise prevent the medication doses from being forced against the backing sheet with sufficient force to rupture it.

The steps 8 in the longer side walls 7 of the blister allow the blister to collapse progressively from the front face 5 when downward pressure is applied to it. The steps 8 also allow neighboring blisters interconnected by the ducts 10 to expand slightly, if they have not been previously opened, so that air flowing through the ducts 10 can escape.

Turning next to FIG. 4 it will be noticed that the absence of steps 8 in the flat trapezoidal regions of the shorter side walls 9 at the ends of the blister results in them being more resistant to collapsing than the longer side walls 7. As a consequence, the finger pressure applied to the central portion of the front face 5 causes it to bow downwardly in the middle, as indicated in broken outline parts in FIG. 4. This bowing causes the end walls 9 to tilt towards one another about their attachments to the coplanar parts of the blister sheet 1 which are adhesively attached to the backing sheet 4. This tilting causes any medication doses adjacent the tilting side walls 9 to be pushed towards the central portion of the blister cavity where rupturing of the foil, diagrammatically illustrated at 12, is most likely to occur. There is thus less risk of a medication dose being in advertently retained in the opened blister by being trapped between the edge of the front face 5 and the shorter side walls of the blister.

The invention claimed is:

1. A blister sheet having a planar back and provided with a blister having first and second pairs of side walls and a front face held spaced from the plane of the back of the sheet by the side walls, the blister being of elongated shape and the first pair of side walls being longer than the second pair of side walls, the first pair of side walls being so formed that they yield under finger pressure applied to the front face of the blister while progressively collapsing from the front face in response to increasing finger pressure being applied to the front face, and the second pair of side walls responding to the finger pressure by tilting towards one another so that any medication dose which may be located against a tilting side wall is displaced towards a position lying beneath the front face and from which it can be ejected by increasing finger pressure, and wherein the first pair of side walls are formed with parallel steps, and the second pair of side walls have their central regions devoid of steps or corrugations and of planar trapezoidal shape so that they can tilt towards one another about their edges where they join the portions of the blister sheet from which the associated blister protrudes.

* * * * *